US005809974A

United States Patent [19]

Osakabe

[11] Patent Number: 5,809,974

[45] Date of Patent: Sep. 22, 1998

[54] ENGINE ELECTRICAL SYSTEM

[75] Inventor: Takayuki Osakabe, Hamamatsu, Japan

[73] Assignee: Sanshin Kogyo Kabushiki Kaisha, Japan

[21] Appl. No.: 867,164

[22] Filed: Jun. 2, 1997

[30] Foreign Application Priority Data

May 31, 1996 [JP] Japan ..... 8-139079

[51] Int. Cl.[6] ..... F02M 51/00; B63H 20/00

[52] U.S. Cl. ..... 123/494; 123/73 C; 73/756

[58] Field of Search ..... 123/494, 73 C; 73/756, 866.5

[56] References Cited

U.S. PATENT DOCUMENTS

| | | | |
|---|---|---|---|
| 5,127,373 | 7/1992 | Mochizuki et al. | 123/73 R |
| 5,404,843 | 4/1995 | Kato | 123/73 B |
| 5,522,370 | 6/1996 | Katoh et al. | 123/865 |
| 5,579,745 | 12/1996 | Katoh et al. | 123/679 |
| 5,584,281 | 12/1996 | Katoh | 123/681 |
| 5,666,935 | 9/1997 | Kato | 123/687 |

*Primary Examiner*—Tony M. Argenbright
*Assistant Examiner*—Hieu T. Vo
*Attorney, Agent, or Firm*—Knobbe, Martens, Olson & Bear

[57] ABSTRACT

An electrical system for an engine of the type utilized to power an outboard motor is disclosed. The engine has a body with a crankshaft rotating therein. At least one fuel injector supplies fuel to the engine for combustion. The electrical system includes an electronic engine control unit for controlling at least the fuel injector based upon one or more sensed conditions. The electrical system also includes at least one sensor for providing data regarding one or more conditions. Preferably, at least an air pressure and intake air temperature sensor are provided. The sensors are mounted to a portion of the engine body adjacent the crankshaft, preferably via a vibration isolated bracket, for improving sensor accuracy and reliability.

20 Claims, 9 Drawing Sheets

ENGINE ELECTRICAL SYSTEM

FIELD OF THE INVENTION

The present invention relates to an electrical system for an engine. More particularly, the invention relates to a mounting arrangement for at least one sensor of an electrical system of an engine.

BACKGROUND OF THE INVENTION

It is now common to control various functions of internal combustion engines with electronic engine control units. These engine control units control such functions as fuel injector injection timing, spark timing and air and fuel ratio, all based upon engine operating conditions.

To provide the engine control unit with information about the engine operating conditions, various sensors are employed. For example, ambient air temperature and air pressure sensors are often utilized for calculating the density of the air, and thus the air/fuel ratio which is to be supplied to the engine. Other sensors may be provided, such as exhaust sensors, coolant temperature sensors and the like.

Typically, the ambient air temperature and pressure sensors are mounted along an intake pipe or passage remote from the main body of the engine. This arrangement has the disadvantage that engine vibration may result in damage to the sensor and otherwise affect the sensor's reliability and accuracy.

An additional problem arises when the engine is positioned within a small housing, such when the engine is utilized to power an outboard motor and positioned in a cowling of the motor. In such an application, the engine space is often greatly limited, making it difficult to provide space for mounting the sensor(s).

An improved electrical system for an engine having one or more sensors, where the sensors are conveniently mounted and mounted to avoid engine vibrations, is desired.

SUMMARY OF THE INVENTION

In accordance with the present invention, there is provided an improved electrical system for an internal combustion engine of the type which may be positioned within a cowling of an outboard motor for powering a water propulsion device of the motor.

The engine preferably has an engine body in which a crankshaft rotates. Preferably, at least one fuel injector is utilized to provide fuel to the engine for combustion.

The electrical system preferably comprises an electronic engine control unit (ECU) for controlling at least the fuel injector(s) based on one or more sensed conditions. The electrical system also includes at least one sensor for providing data regarding a sensed condition to the control unit. In the preferred embodiment, an air pressure sensor and an intake air temperature sensor provide ambient air pressure and intake air temperature data to the ECU.

Preferably, these sensors are mounted to that portion of the engine body adjacent the crankshaft so as to minimize the vibration to which the sensors are subjected. Also, the sensors are mounted to a mounting which is connected to the engine with resilient mounting means. In the preferred embodiment, the sensors are mounted to a bracket which is connected to the engine through rubber mounts, for further isolating the sensors from vibration.

In accordance with the present invention, the sensors are conveniently mounted alongside the engine. In addition, the sensors are mounted close to the crankshaft and via a vibration isolating mounting, so that sensor accuracy and reliability is improved.

Further objects, features, and advantages of the present invention over the prior art will become apparent from the detailed description of the drawings which follows, when considered with the attached figures.

DETAILED DESCRIPTION OF THE PREFERRED EMBODIMENTS

In general, the present invention relates to the electrical system for an internal combustion engine. More particularly, the invention relates to the mounting arrangement of various of the electrical system components, such as an intake air temperature and/or intake air pressure sensor. The sensor(s) are mounted to the engine adjacent the crankshaft with a vibration isolating mounting, whereby the accuracy and reliability of the sensor(s) are improved.

Figure 1:
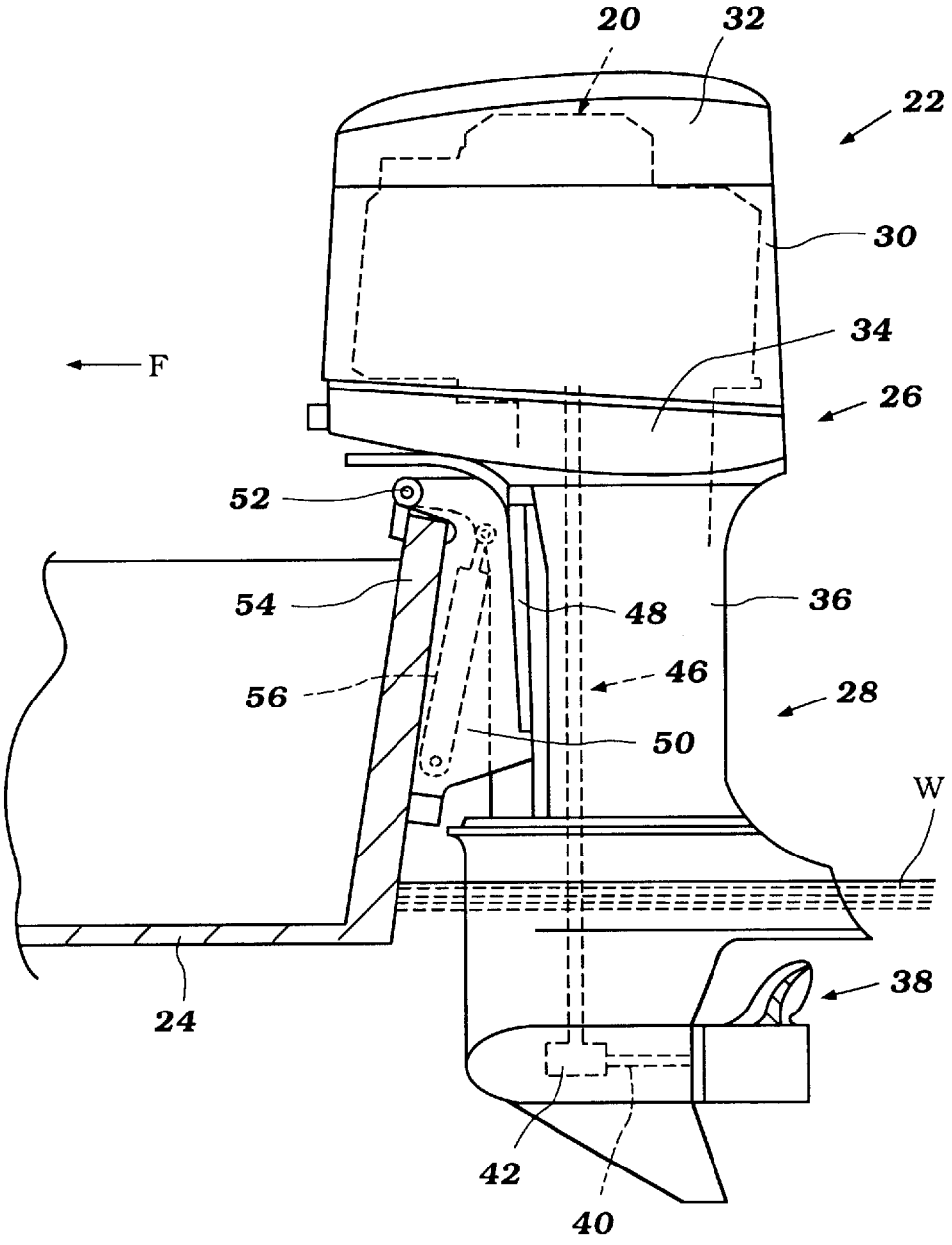
FIG. 1 is a side view, in partial cross-section, of an outboard motor propelling a watercraft, the motor powered by an engine, illustrated in phantom.

The present invention will now be described in more detail with reference to FIG. 1. As illustrated therein, the electrical system of the present invention is particularly well-suited for use with an engine 20 powering an outboard motor 22 which is utilized to propel a watercraft 24.

The outboard motor 22 includes a power head 26 and a lower unit 28. The power head 26 is comprised of a main cowling 30, a cover 32, and a lower tray 34. The engine 20 is housed within the power head 26.

The lower unit 28 depends below the power head 26, generally connected thereto at the tray 34. The lower unit 28 is preferably defined by a casing 36.

The motor 22 further includes a water propulsion device such as a propeller 38. The propeller 38 is positioned at the end of a propeller shaft 40. The propeller shaft 40 extends from the propeller 38 to a transmission 42 positioned within the lower unit 28. The transmission 42 forms no part of the invention herein, and may comprise a conventional forward-neutral-reverse transmission or other transmission found suitable to those skilled in the art.

The engine 20 is arranged so that a crankshaft 44 (see FIG. 3) thereof is vertically extending. The crankshaft drives a drive shaft 46 which extends downwardly through the lower unit 28 to the transmission 42 for driving the propeller 38, as is well known in the art.

The motor 22 is preferably movably connected to the watercraft 24. A vertically steering shaft (not shown) is connected to the motor 22 and positioned within a steering or swivel bracket 48, allowing the motor 22 to be moved left or right about a vertically extending axis for steering the watercraft 24. In addition, the swivel bracket 48 is rotatably connected to a mounting bracket 50 with a horizontally extending pin 52. The mounting bracket 50 is connected to the hull 54 of the watercraft 24. A fluid-operated cylinder 56 is preferably used to raise and lower (i.e. tilt) the motor 22 about the horizontally extending axis through the pin 52.

When the motor 22 is being used to power the watercraft 24 in a body of water, the propeller 38 is positioned below a water level "W" of the body of water, and faces in a direction "F" towards the watercraft 24.

Figure 2:
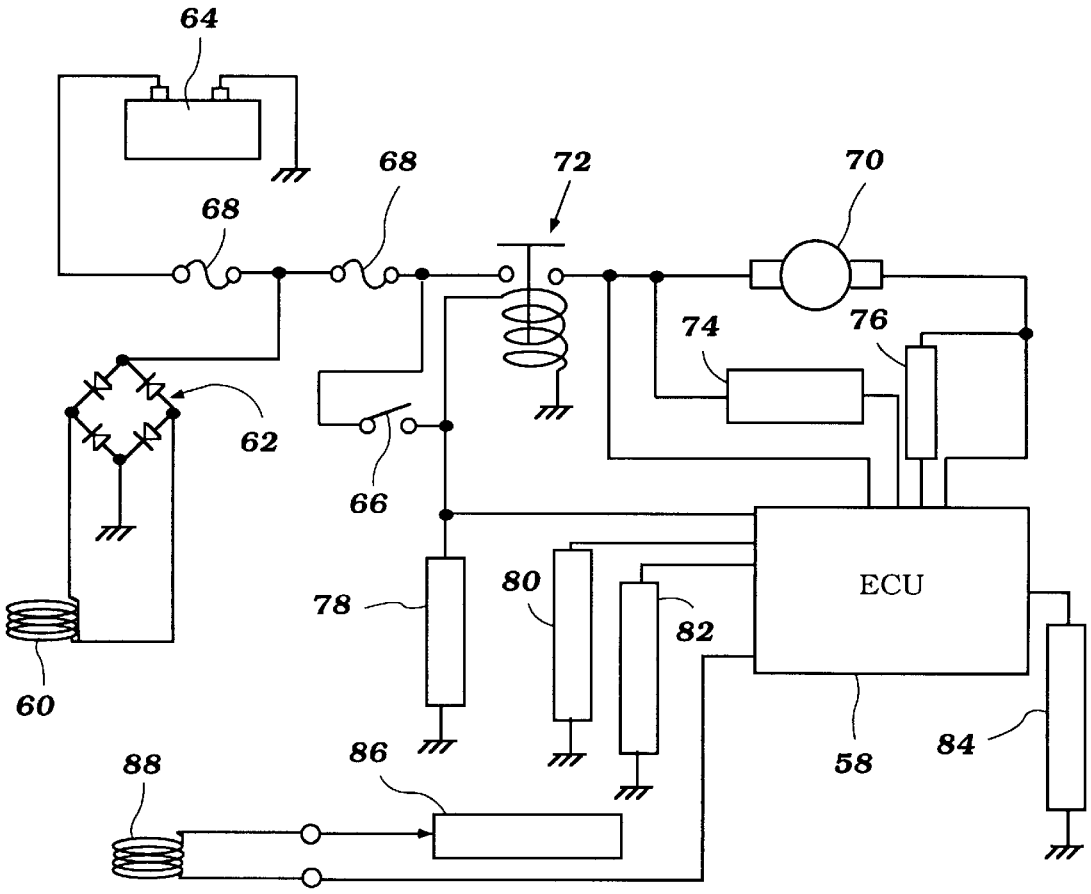
FIG. 2 is a diagram providing an overview of an electrical system of the engine powering the motor illustrated in FIG. 1.

FIG. 2 illustrates in schematic form a part of the electrical system for the motor 22. As illustrated, engine control is governed by an electronic engine control unit (ECU) 58.

The primary power source for the electrical system is a coil 60 which generates an electric current. This coil 60 is preferably arranged to cooperate with magnets positioned on a flywheel (not shown) of the engine 20 for generating this current. Because the current is an alternating current, a rectifier 62 is utilized to covert the current to a direct current.

When the engine 20 is not running or insufficient power is supplied by the coil 60, a battery 64 provides power to the electrical system.

A main switch 66 is positioned along the electrical circuit between the battery 64 and coil 60 for selectively energizing the system, including the ECU 58. When the switch 66 is turned on (such as by turning a key when the switch is a key operated switch) power is provided to the system.

Fuses 68 are provided along the main electrical circuit between the battery 64 and rectifier 62 and the rectifier 62 and the remainder of the electrical circuit for preventing over-loading of the components, such as the fine-wire armature coils of the fuel pump, described next.

A fuel pump 70 is position in the circuit between the ECU 58 and the electrical source (battery 64 and coil 60). Power is supplied to the fuel pump 70 when a relay 72 is closed by the ECU 58. The ECU 58 closes the relay 72 when the engine is being started or is running, so that the fuel pump 70 is operated and will provide fuel to fuel injectors 74 (see also FIG. 3) of the engine 20.

The electrical system is also arranged so that the ECU 58 activates the fuel injectors 74, causing them to inject fuel into the engine 20.

A register 76 is provided along the circuit between the fuel pump 70 and the ECU 58. The register 76 controls the current flow through the windings of the fuel pump 70 to regulate the speed of the fuel pump. The ECU 58 communicates with the register 76 to adjust the pump speed according to the running conditions of the engine 20.

The same electrical circuit powers a number of sensors. As illustrated in FIG. 2, these sensors preferably include a combustion condition sensor in the form of an oxygen sensor 78, an atmospheric pressure sensor 80, engine temperature sensor 82, and intake air temperature sensor 84. The system may include a variety of other sensors as known to those skilled in the art.

The ECU 58 also controls ignition timing. For this purpose, the ECU 58 preferably receives ignition timing data from a crankshaft angle sensor (not shown). This sensor may comprise a pulser coil, as well known to those skilled in the art.

The ignition system includes a capacitor discharge ignition circuit (CDI) 86 which is charged by the output of a conventional charging coil 88. The discharge of the CDI capacitor generates voltage in an ignition coil associated with a spark plug 116 (see FIG. 3) upon receiving the appropriate discharge signal from the ECU 58.

Figure 3:
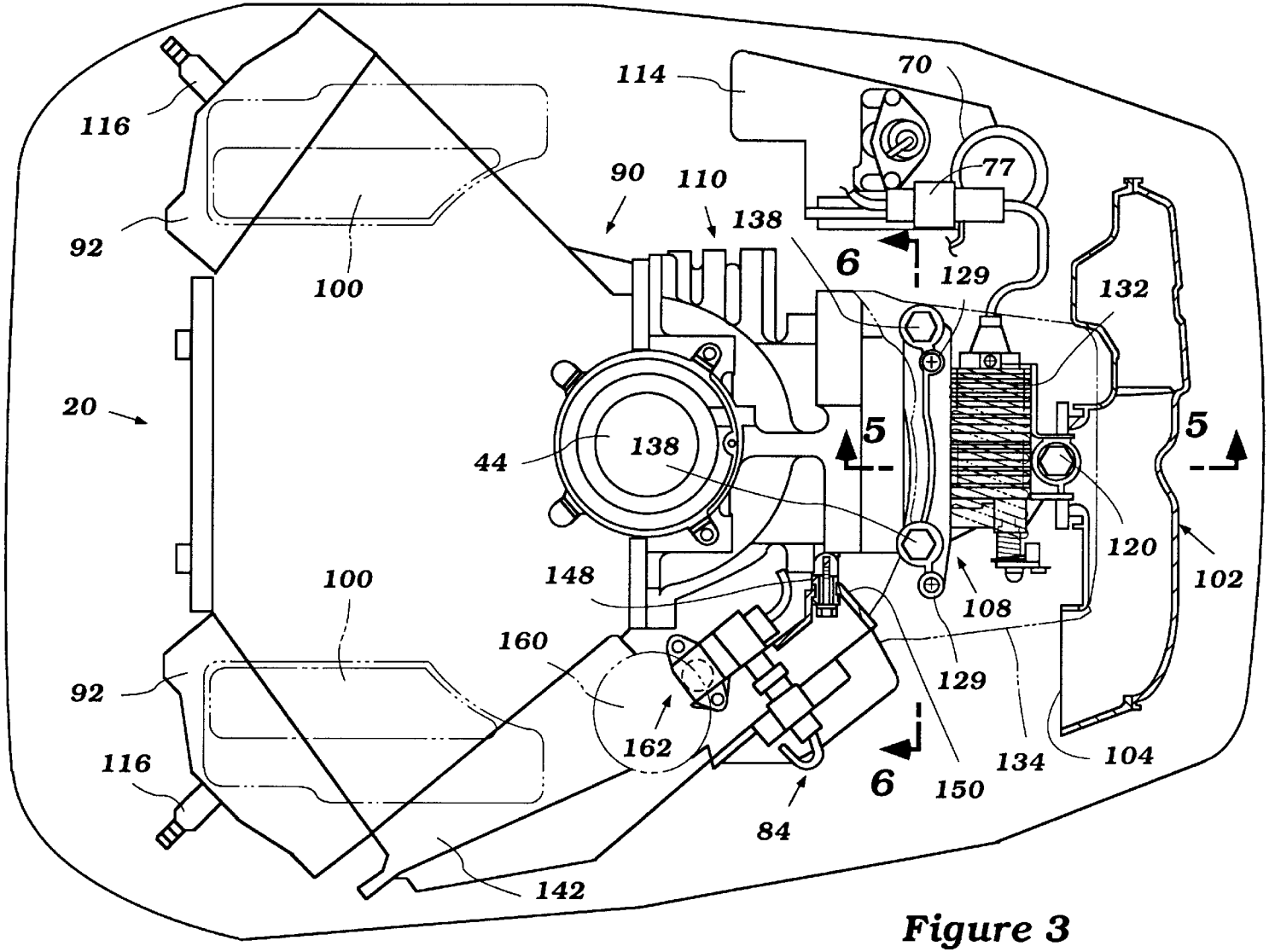
FIG. 3 is a cross-sectional top view of the motor and engine illustrated in FIG. 1 and illustrating the mounting arrangement of certain components of the electrical system, in accordance with the present invention.
Figure 4:
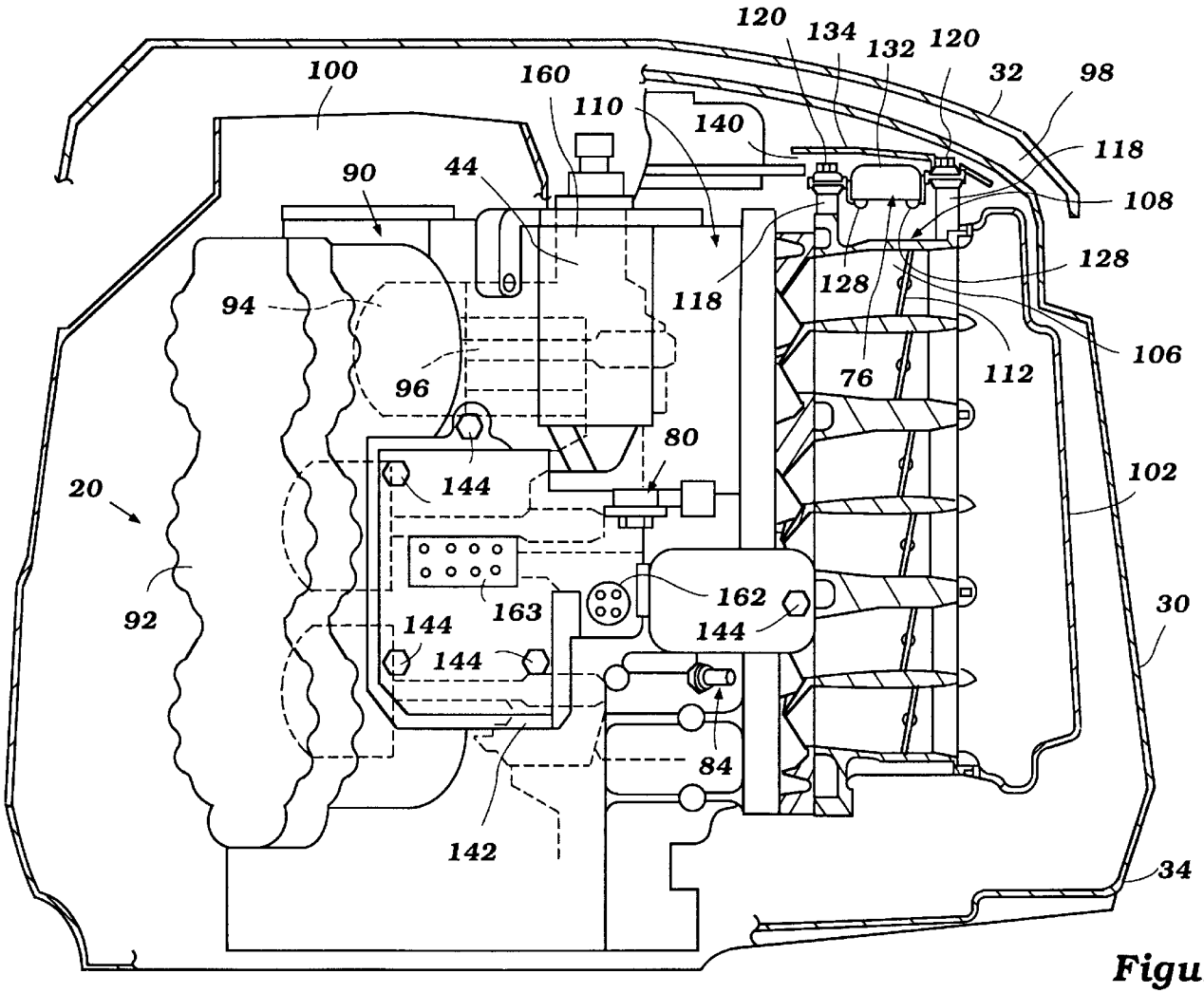
FIG. 4 is a cross-sectional side view of a top portion of the motor illustrated in FIG. 1 and the engine therein.
Figure 5:
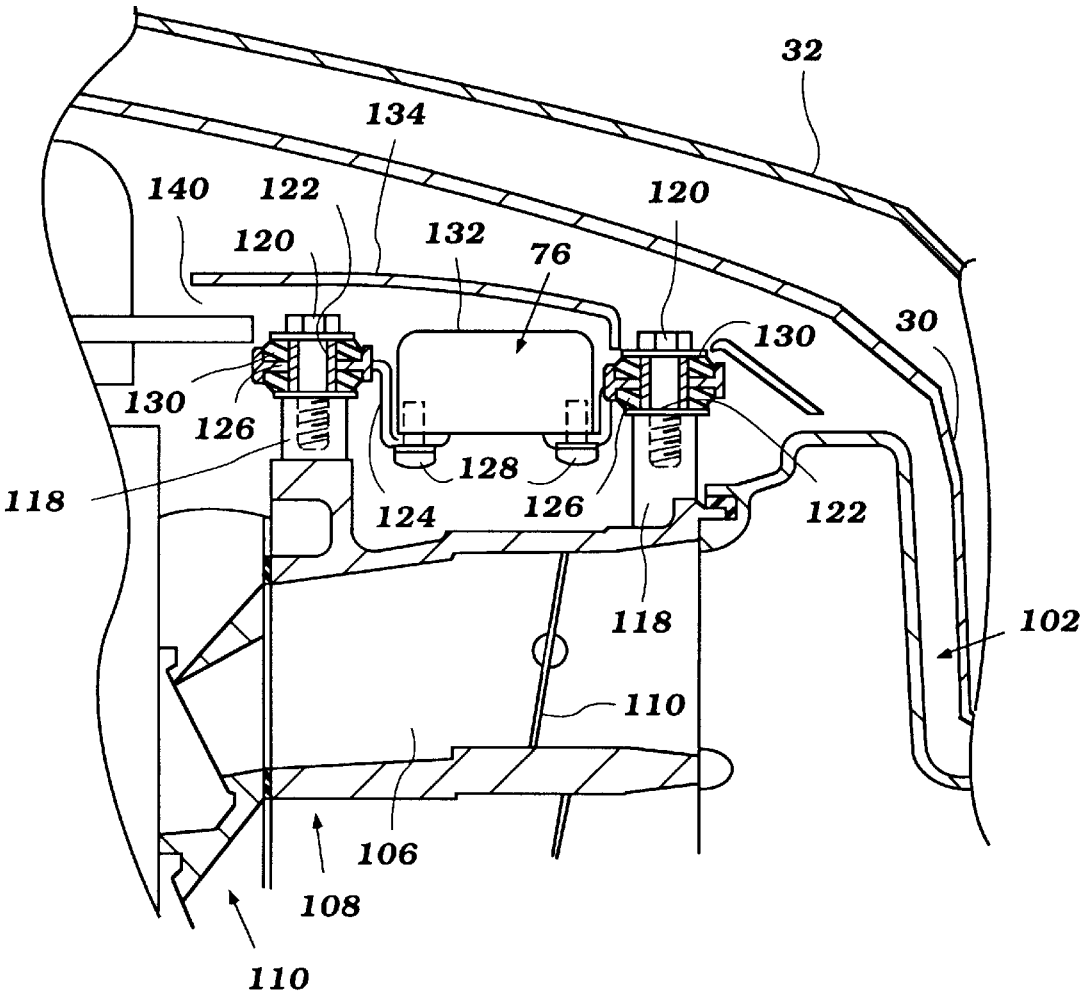
FIG. 5 is a cross-sectional view of a portion of the motor and engine illustrated in FIG. 3 and taken along line 5—5 therein.

FIGS. 3 and 4 generally illustrate the engine 20 with which the electrical system is used. The engine 20 is an internal combustion engine and may of a variety of types known in the art, such as a rotary or reciprocating piston-type. When of the piston type, the engine 20 may be arranged in in-line, opposed, "V" or other configurations. Further, the engine 20 may operate on a two-cycle or four-cycle principle.

The engine 20 illustrated is of the reciprocating piston-type, having six cylinders arranged in "V" fashion, with three cylinders positioned in each of two banks. The engine 20 operates on a two-cycle crankcase compression principle.

The engine 20 has a cylinder block or body 90 defining the cylinders. A cylinder head 92 is connected to the each bank formed by engine 20 across an open end of the cylinders, and cooperates therewith to form a combustion chamber corresponding to each cylinder. A piston 94 is movably positioned in each cylinder, and connected to the crankshaft 44 via connecting rod 96.

An air and fuel charging system provides an air and fuel charge to each cylinder for combustion in the combustion chamber. Air is routed into the cowling 30 through a passage 98 between the cowling and the cover 32, and then through a pair of air intakes 100 in the cowling.

An air intake silencer 102 is provided at the end of the engine 20 opposite the cylinder heads 92. The silencer 102 has an inlet 104 through which air inside the cowling is drawn. This air is directed through throttle passages 106 in a throttle body 108.

The throttle body 108 is connected to a crankcase 110 of the engine 20 positioned opposite the heads 92. The crankcase 110 is defined by the engine body 90. The crankshaft 44 rotates with the crankcase 110. The crankcase 110 is divided into individual chambers corresponding to each cylinder, as is known in the art. The throttle body 108 includes a passage 106 leading to each chamber.

The rate of air flow through each passage 106 is governed by a throttle plate 112 positioned in each passage. The throttle plates 112 are preferably all operated by a single throttle control via a linkage mechanism.

Fuel is supplied into the air passing through each throttle passage 106 with a fuel injector 74 (illustrated only schematically in FIG. 2). Preferably, each injector 74 faces in the direction of the engine 20 and sprays fuel into the air stream flowing through each passage 106 in a path generally parallel thereto.

Fuel is preferably supplied to a vapor separator 114 positioned along side the engine 20 generally between the crankcase portion thereof and the intake silencer 102. This fuel may be supplied by a low pressure pump through a delivery line extending to a tank within the watercraft 24. Fuel within the vapor separator 114 is supplied to each fuel injector 74 by the fuel pump 70, in a manner described above.

The air and fuel mixture is delivered through the throttle body 108 and into each chamber of the crankcase 110 through a reed-type valve (not shown). Each reed valve permits the flow of an air and fuel charge into the chamber, where the charge is partially compressed. During this crankcase compression period, the air and fuel charge is prevented from flowing back into the passage 106 in the throttle body 108 by the same reed valve.

After partial compression, the air and fuel charge is drawn through one or more scavenge passages (not shown) into the cylinders, whereafter it is compressed by the upwardly moving piston 94 therein. Upon compression, the ignition system fires the spark plug 116 and ignites the charge, forcing the piston 94 downwardly and effectuating rotation of the crankshaft 44. Also, as the piston 44 moves downwardly, an exhaust port is uncovered and exhaust gas flows out of the cylinder and through an exhaust system to a point where it is discharged from the motor 22.

In accordance with the present invention, a mounting arrangement is provided for various components of the electrical system thereof.

FIGS. 3–6 illustrate the mounting arrangement for the register 76. Preferably, this mounting includes means for isolating the register 76 from engine vibrations and for preventing the register 76 from overheating.

As illustrated, a pair of bosses 118 or a similar mounting element(s) extends upwardly from the throttle body 108 between the crankcase 110 of the engine 20 and the intake silencer 102. A bolt 120 extends downwardly into each boss 118 for threading engagement with a passage therein. A collar 122 is provided around each bolt 120 below its head for spacing the head above the boss 118.

A register mounting bracket 124 is supported by each bolt 120 and extends to the register 76. Each bracket 124 has a first portion which has a bore 126 through which the collar 122 (as positioned on the bolt 120) extends. The bracket 124 has a portion extending from the first portion generally downwardly (towards the throttle body 108) and then under a bottom surface of the register 76, where it is connected to the register 76 with a bolt, screw or similar fastener 128. Each mounting bracket 124 supports a side of the register 76 so that the register 76 is supported above the throttle body 108 and between the bosses 118.

Preferably, the portion of each bracket 124 which is connected to the collar 122 is positioned between a pair of rubber or similar resilient washers or grommets 130. A first grommet 130 is positioned below the bracket 124 between the bracket 124 and the boss 118. A second grommet 130 is positioned between the head of the bolt 120 and the bracket 124. The grommets 130 serve to vibration isolate the brackets 124, and thus the supported register 76, from the remainder of the engine 20.

Figure 6:
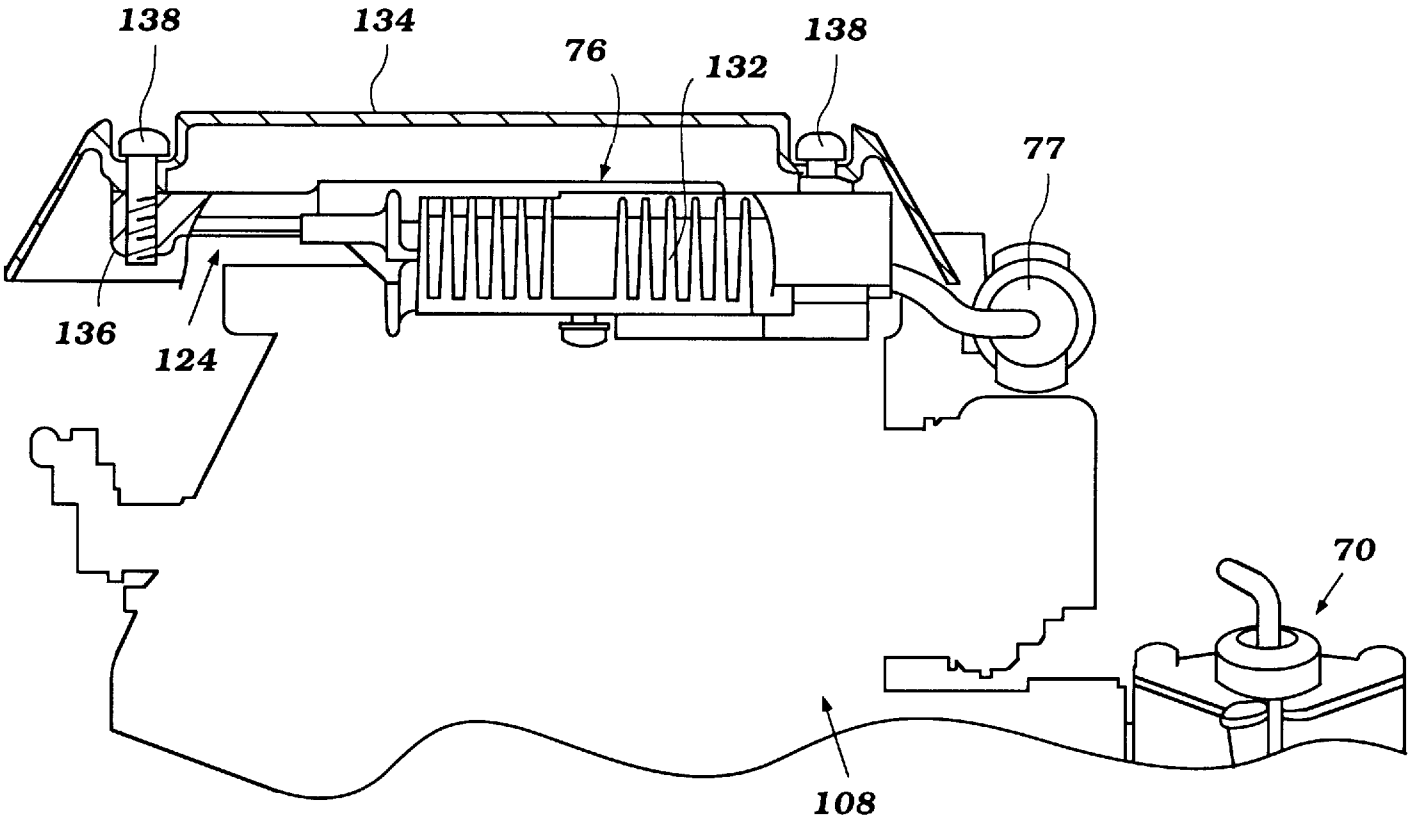
FIG. 6 is a cross-sectional view of a portion of the motor and engine illustrated in FIG. 3 and taken along line 6—6 therein.

As best illustrated in FIGS. 3 and 6, the top portion of the register 76 preferably has a number of cooling fins 132 on a top surface thereof. In addition, a register cover 134 extends over the top of the register 76. The cover 134 is spaced from the top of the cooling fins 132 of the register 76 by way of a mounting part 136 connected to the throttle body 108. A pair of bolts 138 and a pair of screws 129, or similar fasteners, secure the cover 134 to the mounting part 136. So arranged, a space 140 is provided between the register 76 and cover 134 through which air may flow for cooling the register 76.

Preferably, an electric wire extends from the register 76 to a coupler 77 which is connected to the electric circuit. In this manner, the register 76 may easily be connected and disconnected from the engine 20, including the electrical circuit.

As generally illustrated in FIGS. 3 and 4, the atmospheric pressure sensor 80 and intake air temperature sensor 84 are preferably both mounted to the side of the engine 20 generally opposite the vapor separator 114.

Figure 7:
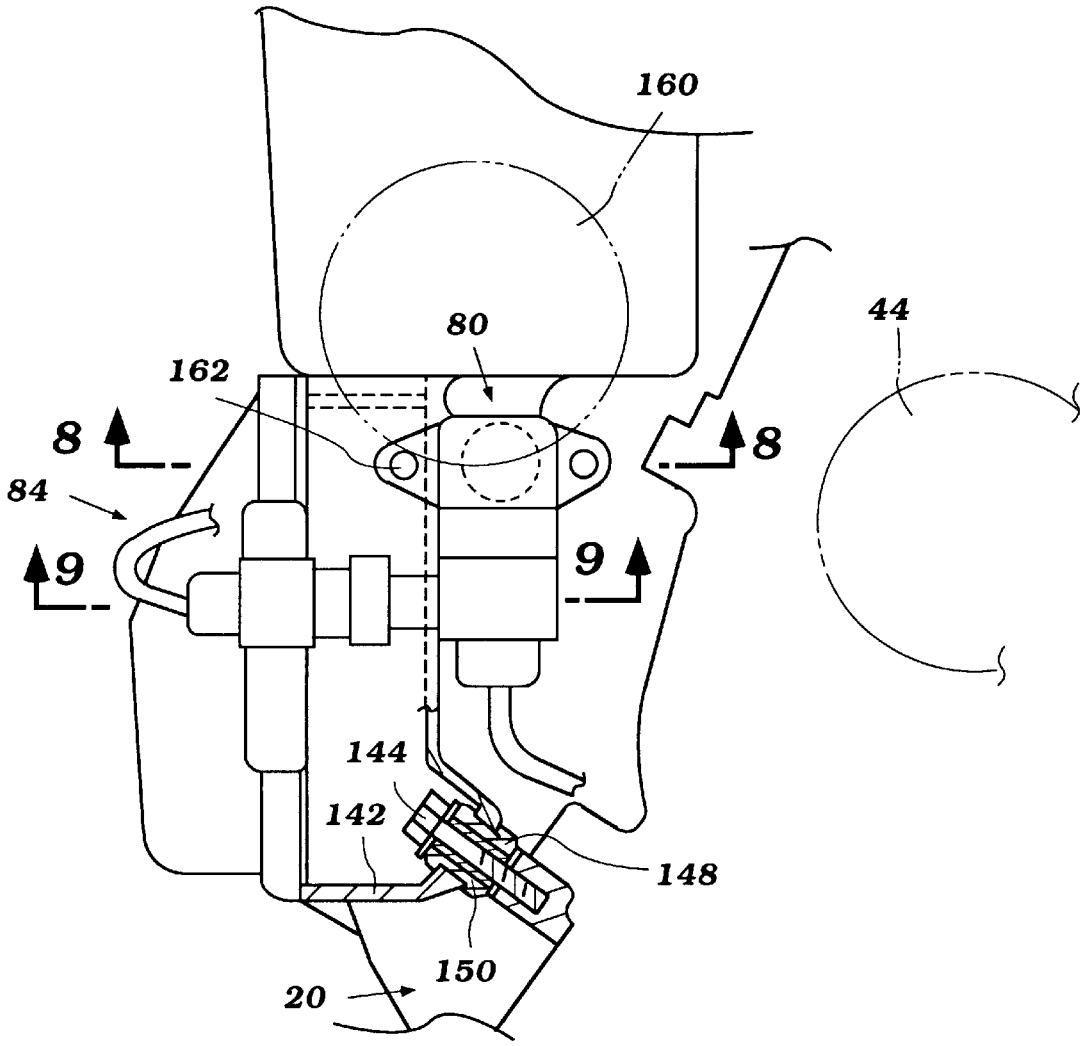
FIG. 7 is a side view, in partial cross-section, of a portion of the engine illustrated in FIG. 2.

A mounting bracket 142 is connected to the side of the engine 20 along the crankcase 110 and between the cylinder head 92 of one bank and the intake silencer 102. The bracket 142 is preferably connected to the engine 20 via several bolts 144 or similar fasteners (see FIG. 4). Preferably, this mounting includes means for vibration isolating the bracket 142 from the engine 20. As illustrated in FIG. 7, each bolt 144 has a collar 146 over its shaft adjacent its head. A rubber grommet 148 or similar resilient or elastic member is positioned over the collar 146 between the head of the bolt 144 and the portion of the engine to which it is engaged. The bracket 142 is connected to the grommet 148. In this manner, the grommet 148 serves to vibration isolate (via damping) the bracket 142 from the engine 20.

Besides the atmospheric pressure sensor 80 and the temperature sensor 84, the bracket 142 may carry such other electrical system features as an electric trim mechanism relay 163 and a starter motor relay 162.

Figure 8:
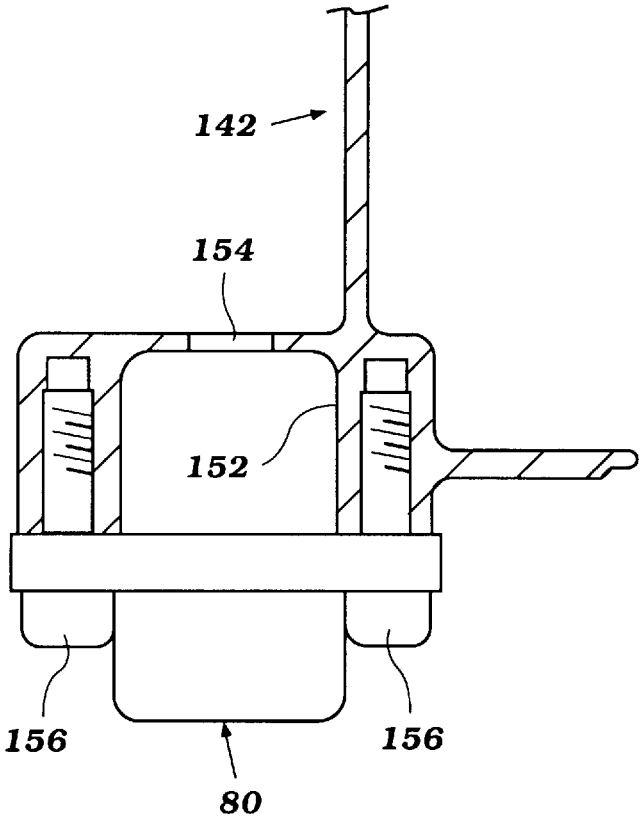
FIG. 8 is a cross-sectional view of the part of the engine illustrated in FIG. 7 taken along line 8—8 therein.

As best illustrated in FIGS. 7 and 8, the atmospheric pressure sensor 80 is mounted to the bracket 142. The bracket 142 includes a receiving portion 152 defining a generally hollow space. The pressure sensor 80 is mounted over an open end of the receiving portion 152 and generally encloses it, except for a port 154 through the bracket 142 leading to the space defined by the receiving portion 152 and sensor 80. This port 154 permits measurement of the atmospheric pressure, and at the same time isolates the sensor 80 from air pressure fluctuations within the cowling to a degree necessary to provide accurate results. The sensor 80 is connected to the receiving portion 152 with a pair of bolts 156.

Figure 9:
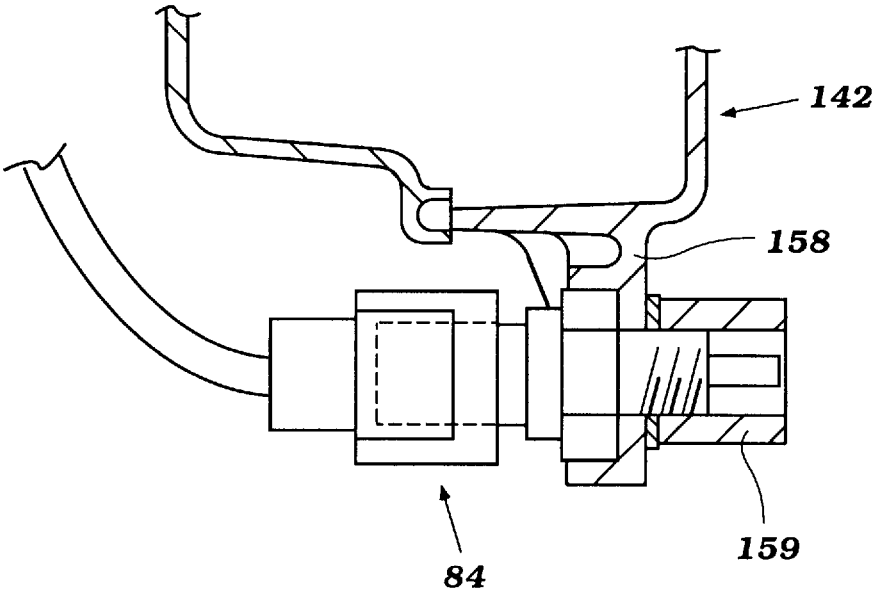
FIG. 9 is a cross-sectional view of the part of the engine illustrated in FIG. 7 taken along line 9—9 therein.

The intake air temperature sensor 84 is preferably also mounted to the bracket 142, as illustrated in FIGS. 7 and 9. A flange 158 extends from the bracket 142 near the receiving portion 152 of the bracket. The flange 158 has a passage through which the intake air temperature sensor 84 extends. The sensor 84 is connected to the flange 158, and arranged so that its detection end extends through a mounting element 159 into an air space defined within one of the passages 106 through the throttle body 108, for measuring the intake air temperature.

As illustrated in FIGS. 3, 4 and 7, a starter motor 160 is mounted alongside the engine 20 and arranged to have its starter gear engage teeth on a flywheel (not shown) connected to the crankshaft 44 for starting the engine 20. A starter relay 162 is provided for activating the starter. The relay 162 is preferably mounted to the bracket 142 near the atmospheric pressure sensor 80.

Advantageously, the sensors, including the atmospheric pressure and temperature sensors 80,84 are mounted to the engine 20 adjacent the crankshaft 44. Because of their proximity to the crankshaft 44, the amplitude of engine vibrations transmitted to the sensors 80,84 is small, contributing to better sensor accuracy and longer sensor life. In addition, the mounting of the sensors 80,84 to the vibration isolated bracket 142 serves to further isolate the sensors 80,84 from engine vibrations.

It should be understood that while the sensors are mounted to a vibration isolating bracket 142, not all vibration may be prevented from being transmitted to the sensors. Preferably, however, the mounting serves to at least substantially reduce the vibrations transmitted therethrough to the sensors.

Of course, the foregoing description is that of preferred embodiments of the invention, and various changes and modifications may be made without departing from the spirit and scope of the invention, as defined by the appended claims.

What is claimed is:

1. An engine having a body in which a crankshaft rotates, said engine positioned within a cowling of an outboard motor, said crankshaft arranged to drive a water propulsion device of said motor, said engine including at least one fuel injector providing fuel to said engine for combustion therein, said engine including an electrical system comprising at least one sensor for providing sensor data to a control unit, said control unit controlling said fuel injector based upon said sensor data, said sensor resiliently mounted to a portion of said engine body generally adjacent said crankshaft therein and within said cowling of said motor.

2. The engine in accordance with claim 1, wherein said at least one sensor comprises an intake air temperature sensor.

3. The engine in accordance with claim 1, wherein said engine is oriented so that said crankshaft is generally vertically extending.

4. The engine in accordance with claim 1, including a bracket connected to said engine with resilient mounting means, said sensor mounted to said bracket.

5. The engine in accordance with claim 4, wherein said resilient mounting means comprises at least one elastic member arranged to dampen vibrations generated by said engine.

6. The engine in accordance with claim 4, wherein said bracket is connected to said engine through at least one rubber member.

7. The engine in accordance with claim 4, wherein said at least one sensor comprises an air pressure sensor and said sensor cooperates with said bracket to form an air pressure monitoring chamber.

8. An engine having an engine body, said body having a first end and a second end, said body defining a crankcase at said second end and having at least one head member connected to said first end, said head member cooperating with said body to define at least one combustion chamber, a crankshaft rotatably positioned at least partially within said crankcase, said engine positioned within a cowling of an outboard motor, said crankshaft in driving relation with a water propulsion device of said motor, said engine further including an induction system for providing an air and fuel charge to said engine, said induction system positioned at said second end of said engine and including at least one fuel injector for providing fuel into air supplied to each combustion chamber, said engine having an electrical system including a control unit for controlling said at least one fuel injector based upon at least one sensed condition, and at least one sensor for providing data to said control unit, a bracket connected to said engine with resilient mounting means, said at least one sensor mounted to said bracket.

9. The engine in accordance with claim 8, wherein said at least one sensor is mounted near said crankshaft of said engine.

10. The engine in accordance with claim 8, wherein said bracket is connected to said engine with at least one bolt, said resilient mounting means comprising a rubber member positioned between said bolt and bracket.

11. The engine in accordance with claim 8, including at least one air intake passage leading to said crankcase, said at least one sensor mounted to said crankcase adjacent said at least one air intake passage.

12. An engine having a body in which a crankshaft rotates, at least one fuel injector providing fuel to said engine for combustion therein, said engine including an electrical system comprising at least one sensor for providing sensor data to a control unit, said control unit controlling said fuel injector based upon said sensor data, said sensor mounted to a portion of said engine body generally adjacent said crankshaft therein with a bracket connected to said engine with resilient mounting means.

13. The engine in accordance with claim 12, wherein said sensor comprises an air pressure sensor and said bracket cooperates with said sensor to form an air pressure monitoring chamber.

14. The engine in accordance with claim 12, wherein said resilient mounting means comprises at least one rubber mount member.

15. An engine having an engine body, said body having a first end and a second end, said body defining a crankcase at said second end and having at least one head member connected to said first end, said head member cooperating with said body to define at least one combustion chamber, a crankshaft rotatably positioned at least partially within said crankcase, an induction system for providing an air and fuel charge to said engine, said induction system positioned at said second end of said engine and including at least one fuel injector for providing fuel into air supplied to each combustion chamber, said engine having an electrical system including a control unit for controlling said at least one fuel injector based upon at least one sensed condition, and at least one sensor for providing data to said control unit, said at least one sensor mounted to said first end of said engine adjacent said crankcase with via a mount connected to said engine with resilient mounting means.

16. The engine in accordance with claim 15, wherein said sensor comprises an intake air pressure sensor.

17. The engine in accordance with claim 15, wherein said at least one sensor comprises an intake air temperature sensor.

18. The engine in accordance with claim 15, including at least one additional electrical component resiliently mounted to said top end of said engine.

19. The engine in accordance with claim 15, wherein a cover extends at least partially over said component and spaced therefrom to define an air space between said cover and component.

20. The engine in accordance with claim 19, wherein said component is an electrical register.

* * * * *